US007295968B2

(12) United States Patent
Bietrix et al.

(10) Patent No.: US 7,295,968 B2
(45) Date of Patent: Nov. 13, 2007

(54) DEVICE AND METHOD FOR PROCESSING AN AUDIO SIGNAL

(75) Inventors: Franck Bietrix, Paris (FR); Hubert Cadusseau, Paris (FR)

(73) Assignee: Wavecom, Issy-les-Moulineaux Cedex (FR)

( * ) Notice: Subject to any disclaimer, the term of this patent is extended or adjusted under 35 U.S.C. 154(b) by 455 days.

(21) Appl. No.: 10/477,816

(22) PCT Filed: May 15, 2002

(86) PCT No.: PCT/FR02/01640

§ 371 (c)(1),
(2), (4) Date: May 24, 2004

(87) PCT Pub. No.: WO02/093558

PCT Pub. Date: Nov. 21, 2002

(65) Prior Publication Data

US 2004/0236572 A1 Nov. 25, 2004

(30) Foreign Application Priority Data

May 15, 2001 (FR) ..... 01 06412

(51) Int. Cl.
*G10L 21/00* (2006.01)

(52) U.S. Cl. ..... 704/200; 704/203

(58) Field of Classification Search ..... 704/200, 704/203

See application file for complete search history.

(56) References Cited

U.S. PATENT DOCUMENTS

| | | | | |
|---|---|---|---|---|
| 5,394,473 | A | 2/1995 | Davidson | 381/36 |
| 6,370,500 | B1 * | 4/2002 | Huang et al. | 704/208 |
| 6,418,405 | B1 * | 7/2002 | Satyamurti et al. | 704/206 |
| 6,810,273 | B1 * | 10/2004 | Mattila et al. | 455/570 |

OTHER PUBLICATIONS

"A block least squares approach to acoustic echo cancellation", Woudenberg et al., Acoustics, Speech, and Signal Processing, Mar. 15, 1999, pp. 869-872.

"Fenster FÜR die FFT—wozu eigentlich?", Schumann AGH, Elektronik 18/1999, pp. 100-102, 105-106.

* cited by examiner

*Primary Examiner*—Daniel Abebe
(74) *Attorney, Agent, or Firm*—Steven M. Koehler; Westman, Champlin & Kelly, P.A.

(57) ABSTRACT

The invention concerns audio signal processing, comprising: a first processing of an audio source signal, using at least a mathematical transform applied on first sequences of samples obtained by applying first segmentation windows on the audio source signal; and a second audio processing applied on second sequences of samples obtained by applying second segmentation windows on the signal delivered by the first step; the two successive first windows and/or the two successive second windows overlapping, the overlaps being such that the segmentations are synchronous.

18 Claims, 7 Drawing Sheets

DEVICE AND METHOD FOR PROCESSING AN AUDIO SIGNAL

CROSS-REFERENCE TO RELATED APPLICATION

This Application is a Section 371 National Stage Application of International Application No. PCT/FR02/01640, filed May 15, 2002 and published as WO 02/093558 on Nov. 21, 2002, not in English.

FIELD OF INVENTION

This invention relates to the field of processing audio signals.

More precisely, this invention relates to, in particular, the reduction or cancellation of noise in an audio signal via a digital communication device, for example a digital telephone and/or hands-free mobile radiotelephone.

BACKGROUND OF THE INVENTION

When digital audio communication devices are used in a noisy environment (typically inside a car), the latter can greatly disturb an audio signal and consequently degrade the quality of the communication.

According to known techniques, noise suppressors or cancellers are inserted to resolve this problem, acting on the signal picked up by a microphone, prior to specific processing of the audio signal.

According to a first known technique, an echo or noise cancellation and reduction device is installed between a microphone designed to pick up an audio signal and an audio signal processing device. This device improves the useful signal to noise ratio or suppresses the echo so that the signal can then be processed under optimal conditions. However, this prior art technique requires a specifically dedicated device, which has the inconvenience of generating additional costs and increased application complexity.

According to a second known technique, the noise reduction function, based on the use of a Fast Fourier Transform (FFT) applied to a continuous flow of speech samples, is integrated into the digital communication device. In the first instance, the flow of samples is cut into windows of 256 samples obtained via the application of a formatting window, the windows half overlapping (the first 128 samples of a window corresponding to the last 128 samples of the preceding window). An FFT is applied to each window and then the result of the FFT is processed by a noise or echo cancellation or reduction function.

Then, the result of this function is processed via an Inverse Fast Fourier Transform (IFFT) so as to reconstitute a flow of speech samples which could be processed via a speech processing function.

An inconvenience of this prior art technique is that it is relatively complicated to implement.

The invention according to its different aspects is notably purposed to compensate for these inconveniences of the prior art.

More precisely, one purpose of the invention is to provide a method and an audio processing device in a device which allows a reduction in the complexity of processing based on a mathematical transformation being applied to data blocks whilst optimising the audio processing being applied to audio frames.

Another purpose of the invention is to optimise the integration of the processing based on a mathematical transformation and of the audio processing.

A purpose of the invention is also to optimise the duration of this processing.

Another purpose of the invention is to reduce the computing power needed for this processing.

SUMMARY OF THE INVENTION

With these purposes in mind, the invention proposes a method of processing an audio signal, comprising:

- a first step of processing a source audio signal, implementing at least one mathematical transformation applied to first sample sequences obtained via the application of first segmentation windows on the source audio signal; and
- a second step of audio processing, applied to second sample sequences obtained via the application of second segmentation windows on the signal delivered by the first step, the second segmentation windows being distinct from the first segmentation windows;
- remarkable in that two successive first windows and/or two successive second windows overlap, the overlapping being such that the segmentations are synchronous.

Thus, the steps of audio processing can be implemented in a sequential manner or in a multitask environment. Furthermore, this implementation is facilitated via the use of memory with predictable, precise and economic provisioning.

According to a specific characteristic, the process is remarkable in that the second segmentation windows are successive frames.

Thus, according to the invention, the duration of processing of the method is optimised.

According to a specific characteristic, the method is remarkable in that the last sample of a first sequence is also the last sample, after the first step, of the corresponding second sequence.

Thus, preferably the second step of audio processing is carried out without useless waiting so as to optimise the overall duration of audio processing.

According to a specific characteristic, the method is remarkable in that each first segmentation window is a window of perfect reconstruction obtained via convolution of:

- a first intermediary window of perfect reconstruction and possessing spectral properties adapted to the mathematical transformation(s); and
- a second rectangular intermediary window.

Thus, the parts of the first segmentation windows which overlap are of perfect reconstruction, which allows a recombining of the signals during the first relatively simple process.

Moreover, the first intermediary window being adapted to the mathematical transformation(s) (in particular there is a reduction of the second lobe of the relatively strong window whereas the main lobe remains flat), the quality of the corresponding processing is optimised.

Furthermore, the second intermediary window being rectangular, the corresponding sample processing is simple and efficient.

According to a specific characteristic, the method is remarkable in that the first processing step applied to each first sequence comprises, in addition:

a pre-set processing sub-step applied to the first sequence;

an inverse mathematical transformation sub-step applied to the processed samples of the first sequence; and a step of adding the speech samples issued from the inverse mathematical transformation sub-step applied to the first sequence and the corresponding speech samples issued from the inverse mathematical transformation sub-step applied to the preceding first sequence.

According to a specific characteristic, the method is remarkable in that the pre-set processing sub-step comprises noise reduction or cancellation in the audio signal.

According to a specific characteristic, the method is remarkable in that the pre-set processing sub-step comprises at least one processing belonging to the group comprising:

an echo reduction or cancellation in the audio signal;

a speech recognition in the audio signal.

Thus, the method advantageously combines processing such as the reduction and/or cancellation of noise and/or echo and/or speech recognition in a device (for example a telephone, personal computer or remote control) which allows a reduction in the complexity whilst optimising the efficiency of this processing and/or a powerful integration of the device (which consequently allows a drop in costs and in energy consumption which is relatively major notably for communication devices operating on batteries).

According to a specific characteristic, the method is remarkable in that the said mathematical transformation(s) belong to the group comprising:

the FFT and their variants;

the Fast Hadamard Transformations (FHT) and their variants; and the Direct Cosine Transformations (DCT) and their variants.

Thus, the invention advantageously allows the use of one or several mathematical transformations adapted to the first audio processing, these transformations being applied to blocks different in size to the size of the second segmentation windows.

According to a specific characteristic, the method is remarkable in that the source audio signal is a speech signal.

The invention is thus well adapted to the second audio processing when it is specific to speech such as, for example, speech coding ("vocoding") and/or speech compression for memorisation and/or remote transmission.

The invention also relates to a device for processing an audio signal, comprising:

first means of processing a source audio signal, implementing at least one mathematical transformation applied to first sample sequences obtained via the application of first segmentation windows on the source audio signal; and second means of audio processing applied to second sample sequences obtained via the application of second segmentation windows on the signal delivered by the first step, the second segmentation windows being distinct from the first segmentation windows;

remarkable in that two successive first windows and/or two successive second windows overlap, the overlapping being such that the segmentations are synchronous.

Moreover, the invention relates to a computer program product comprising program elements, registered on a readable support by at least one microprocessor, remarkable in that the program elements control the microprocessor(s) so that they carry out:

a first step of processing a source audio signal, implementing at least one mathematical transformation applied to first sample sequences obtained via the application of first segmentation windows on the source audio signal; and a second step of audio processing applied to second sample sequences obtained via the application of second segmentation windows on the signal-delivered by the first step, the second segmentation windows being distinct from the first segmentation windows;

two first successive windows and/or two second successive windows overlap, the overlapping being such that the segmentations are synchronous.

Moreover, the invention relates to a computer program product, remarkable in that the program comprises sequences of instructions adapted to the implementation of a method of audio processing such as is previously described when the program is run on a computer.

The advantages of the audio signal processing device and of the computer program products are the same as those for the method of processing an audio signal, they are not described in any fuller detail.

BRIEF DESCRIPTION OF THE DRAWINGS

Other characteristics and advantages of the invention will become clearer upon reading the following description of a preferable embodiment, given as a simple illustrative and non-restrictive example, and of annexed drawings, among which.

DETAILED DESCRIPTION OF THE PREFERRED EMBODIMENTS

Figure 1:
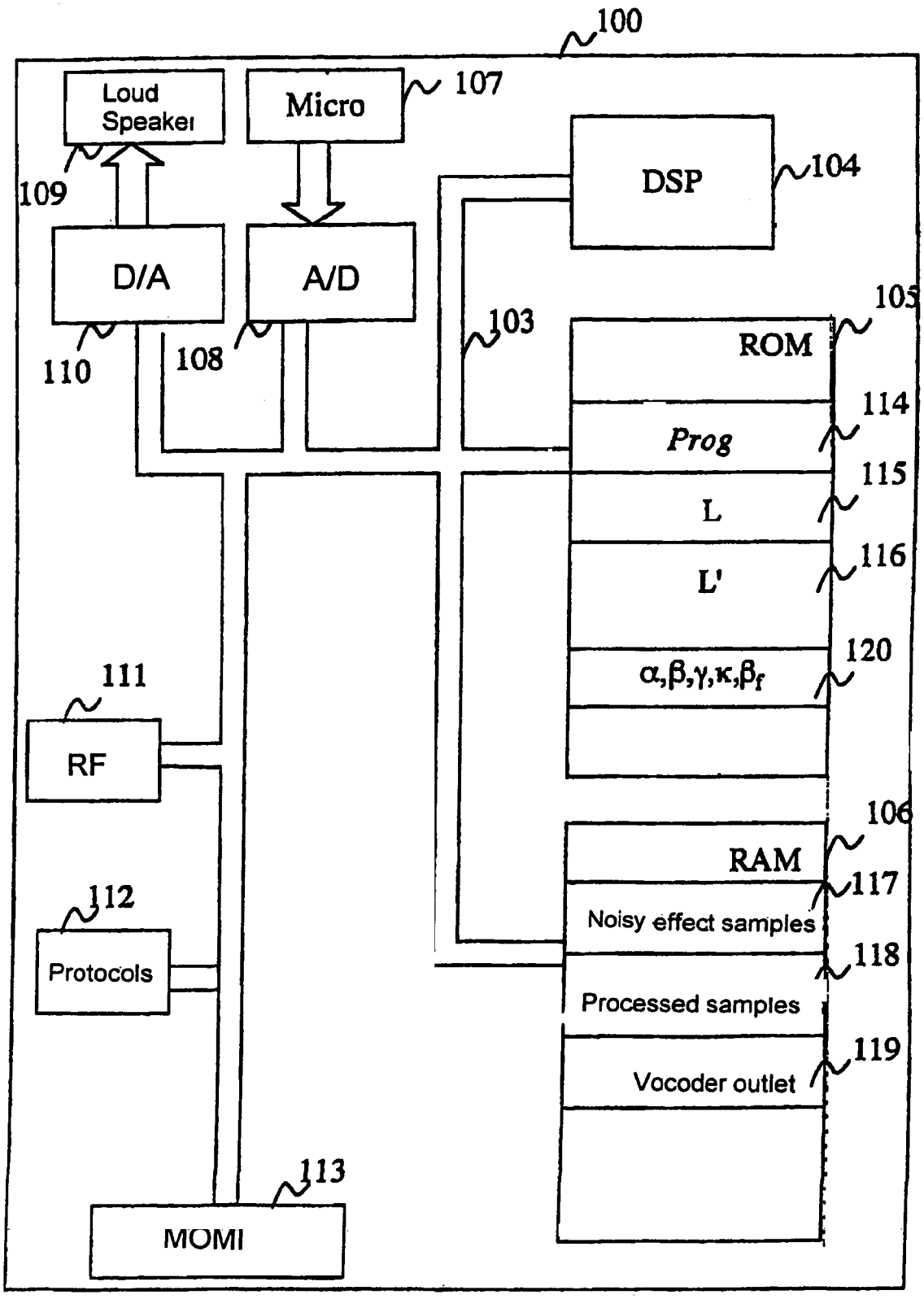
FIG. 1 shows a block diagram of a radiotelephone, in compliance with the invention according to a specific embodiment.

The general principle of the invention lies in the synchronisation:

of the processing based on an FFT notably noise cancellation or reduction processing; and speech processing of speech coding type.

Indeed, the FFT and IFFT process the windows comprising a magnitude order of 2 samples (typically 128 or 256).

On the other hand, speech coding takes into account windows of different sizes (typically the speech processing in the context of GSM considers windows of 160 samples).

In the case, for example, of a radiotelephone in compliance with the GSM standards published by the European Telecommunication Standard Institute (ETSI), the speech signal is sampled at a frequency of 8 kHz before being transmitted by a frame of 20 ms in a compressed form to a recipient.

It is noted that, according to the GSM standard, speech coding is carried out on frames of 160 samples, via a vocoder. This coding, which is a function of the desired flow, is notably specified in the following documents:

Full Rate (FR) Speech Transcoding (GSM06.10);

Half Rate (HR) Speech Transcoding (GSM06.20);

Enhanced Full Rate (EFR) Speech Transcoding (GSM06.60);

Adaptive Multi-Rate (AMR) Speech Transcoding (GSM06.90);

According to the state of the art, in considering a window of 160 speech processed samples, the noise and/or echo reduction or cancellation device processes a window of length 256 which can re-cut up to three windows of length 160. It is, amongst others, the asynchronism inherent in this state of the art technique which renders this processing complicated and requires an over-sizing of the memory and of the computing power and/or of the Digital Signal Processor (DSP) clock, used for computing.

According to the invention, the two types of processing are synchronised by systematically coinciding the end of a noise and/or echo reduction or cancellation window with a speech processing frame and preferably with the end of a speech processing frame. Thus, if the noise cancellation or reduction windows have a size equal to 256 samples and if the speech processing frames have a size equal to 160 samples, an echo reduction or cancellation window will contain an entire speech processing frame and 96 samples (that being 256 less 160) from the previous window.

Thus, the synchronism is conserved between the noise reduction or cancellation windows and the speech processing frames and the overall processing lengths are optimised.

According to the invention, a formatting window (adapted to speech frames associated with 160 samples and to FFT with 256 points) is preferably:

- a perfect reconstruction, meaning that the sum of the amplitudes of two windows covering each other is always equal to 1 (for the covered part);
- a window of length 256 with a coverage of 96 on each side.

Such a window is, for example, obtained by the convolution of a Hanning window of length 97 (written as Hanning(97)) with a rectangular window of width 160 (written as Rect(160)).

A FFT with 256 points is then applied to each window of 256 samples synchronised on the frames of 160 samples. The implementation of FFT is well known to those skilled in the art and is notably detailed in the book "Numerical Recipes in C, $2^{nd}$ edition", written by W. H. Press, S. A. Teukolsky, W. T. Vetterling and B. P. Flannery and published in 1992 in the Cambridge University Press editions.

Then a noise reduction algorithm is applied, of every type known per se, before carrying out an inverse transformation operation (written as IFFT) on the block of 256 samples being considered.

Blocks of 256 samples are thus successively processed. After the IFFT operation, the first 96 processed samples of the current window are added to the last 96 processed samples of the previous window. Once added, the first 160 samples of the current window are sent to the vocoder to be processed according to the speech coding methods known per se, in compliance, if need be, with the applicable standard.

A radiotelephone implementing the invention is presented in relation to FIG. 1.

FIG. 1 diagrammatically represents a general synoptic of a radiotelephone, in compliance with the invention according to a preferred embodiment.

The radiotelephone 100 comprises, linked together via an address and data bus 103:

- a microphone 107;
- an analogue-to-digital converter 108;
- a loud speaker 109;
- a digital-to-analogue converter 110;
- a signal processing processor (DSP) 104;
- a non-volatile memory 105;
- a random access memory 106;
- a radio interface 111;
- a unit 112 for the management and control of the exchanges of data frames and protocols; and
- a man/machine interface (typically a keyboard and a screen) 113.

Each of the illustrated elements in FIG. 1 is well known to those skilled in the art. These common elements are not detailed here.

Furthermore, it is observed that the word "register" used throughout the description indicates in each of the aforementioned memories, as much a low capacity memory zone (a little binary data) as a large capacity memory zone (capable of storing an entire program or an entire sequence of transaction data).

The non-volatile memory 105 (or ROM) holds, in registers which through ease have the same names as the data they contain:

- the operating program of the DSP 104 in a "prog" 308 register;
- a value L (typically of value 256), representing a first segmentation window size corresponding to a number of points taken into account by an FFT in a register 115;
- a value L' (typically of value 160), representing a second window size corresponding to a frame size processed by a vocoder in a register 115; and
- values $\alpha$, $\beta$, $\gamma$, $\kappa$ and $\beta_f$ used for the reduction of noise in the signal.

The random access memory 106 holds intermediary processing data, variables and results and notably comprises:

- a register 117 wherein are held noisy sample values of the received signal;
- a register 118 wherein are held processed sample values; and
- a sequence of processed samples purposed for a vocoder.

The DSP is notably adapted to Fourier transformation and speech coding type processes. For example, a DSP core manufactured by the company DSP GROUP (registered trademark) under the reference "OAK" (registered trademark) can be used.

Figure 2:
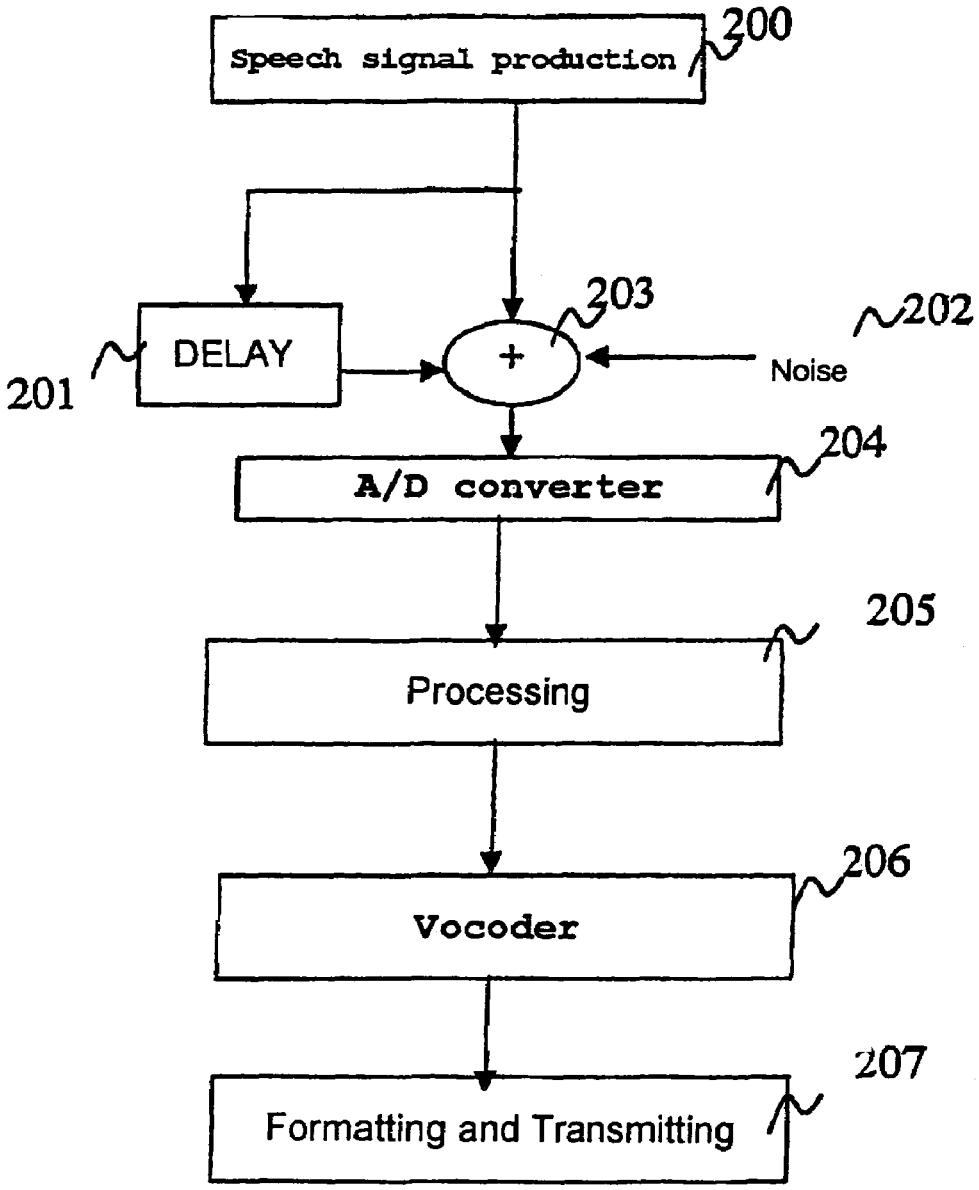
FIG. 2 illustrates the successive processing carried out by the radiotelephone in FIG. 1 on an audio signal.

FIG. 2 illustrates the successive processing carried out by the radiotelephone in FIG. 1 on a speech signal.

It is to be noted that a signal coming in through the microphone 107 is the sum 203 of:

- a speech signal that can be affected by an echo (symbolised by the sum of the produced signal 200 and the delayed produced signal); and
- a noise 202.

The sound effect noise picked up by the microphone 107 is delivered to the analogue-to-digital converter 204 where it is converted into a series of digital samples during a step 204. According to the GSM standard, it is noted that the sampling typically takes place at a frequency equal to 8 kHz.

Then, during a step 205, the series of digital samples is processed.

Then, during a step 206, the frames of L' (160) of processed samples are coded by a vocoder according to a method known per se (typically such as is specified in the GSM standard).

Then, during a step 207, the "vocoded" frames are formatted by the unit 112 so as to be sent by the radio module 111 according to techniques known per se (for example, according to the GSM standard).

Figure 3:
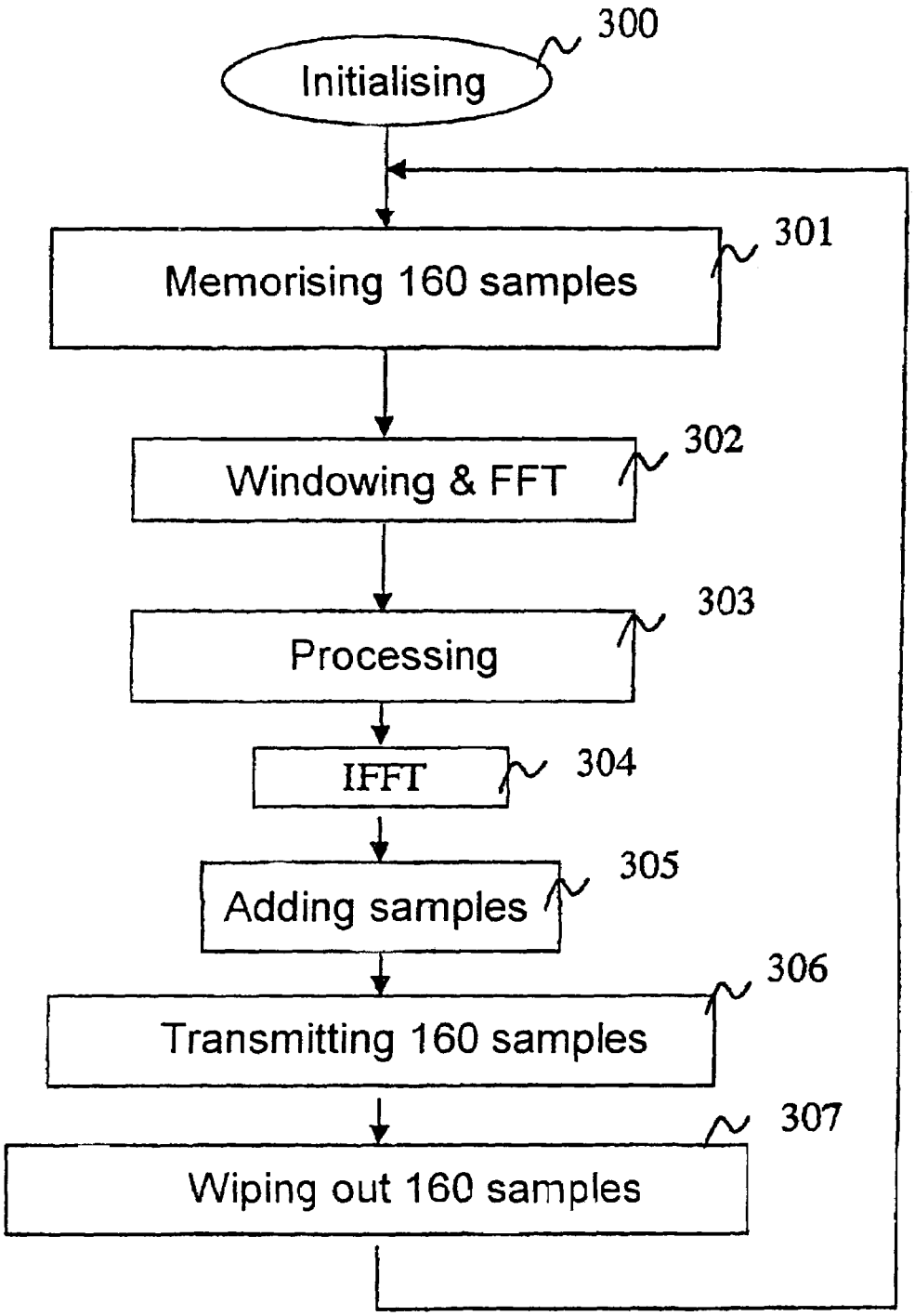
FIG. 3 shows a noise cancellation or reduction algorithm, according to FIG. 2.

FIG. 3 shows a noise cancellation or reduction algorithm implemented in the processing step 205 in FIG. 2.

During an initialisation step 300, the DSP 104 initialises, in the RAM 106, a first block of 96 samples to zero corresponding to the last samples received as well as all the necessary variables for the correct operating of the processing 205.

Then, during step 301, the DSP 104 memorises, in the RAM 106, following on from the previous received samples, a sequence of 160 incoming samples issued from the converter 108.

Then, during a step 302, the DSP 104 applies a segmentation window of length 256 to the sequence formed from the last 256 received samples. (It is noted that this window is illustrated later in FIG. 7).

A mathematical transformation of type FFT with 256 points is then applied to the sequence obtained via the application of the segmentation window.

Then, during a step 303, a noise reduction type processing (detailed later in FIG. 8) is applied to the sequence issued from the mathematical transformation.

Then, during a step 304, an inverse transformation of that of step 302, of type IFFT is applied to the processed sequence.

Then, during a step 305, the DSP 104 adds, if need be (meaning after a first repeat), the last 96 processed samples of the previous processed sequence to the first 96 processed samples of the current sequence.

Then, during a step 306, the formed sequence or frame of the first 160 current processed samples is sent to the vocoder.

Then, during a step 307, the 160 samples received corresponding to the 160 samples sent during the step 305 are wiped from the memory 106.

Then, the step 301 is repeated.

Figure 4:
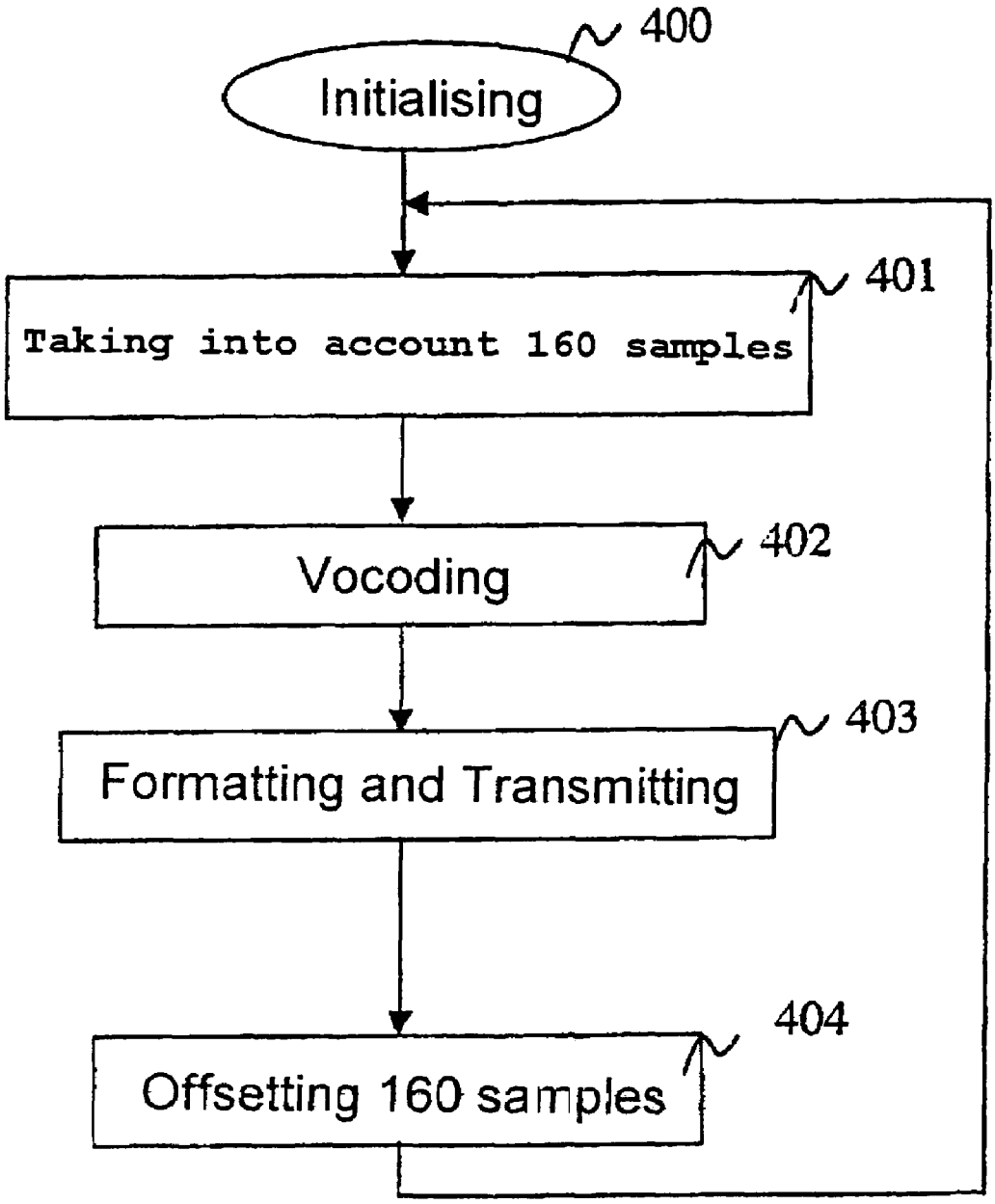
FIG. 4 shows a speech processing applied to a frame, according to FIG. 2.

FIG. 4 shows a speech coding, implemented in step 206 of FIG. 2.

During an initialisation step 400, the DSP 104 initialises, in the RAM 106, all the necessary variables for the correct operating of the coding 206.

Then, during a step 401, the DSP 104 memorises, in the RAM 106, a frame of 160 samples transmitted during the step 307.

Then, during a step 402, the DSP 104 applies a speech coding processing to the frame of 160 samples according to a technique known per se.

Then, during a step 403, the coded frame is formatted and transmitted to the unit 102 to be sent to a recipient.

Then, during a step 404, the frame of 160 samples is wiped from the memory RAM 106.

Then, operation 401 is repeated.

Figure 5:
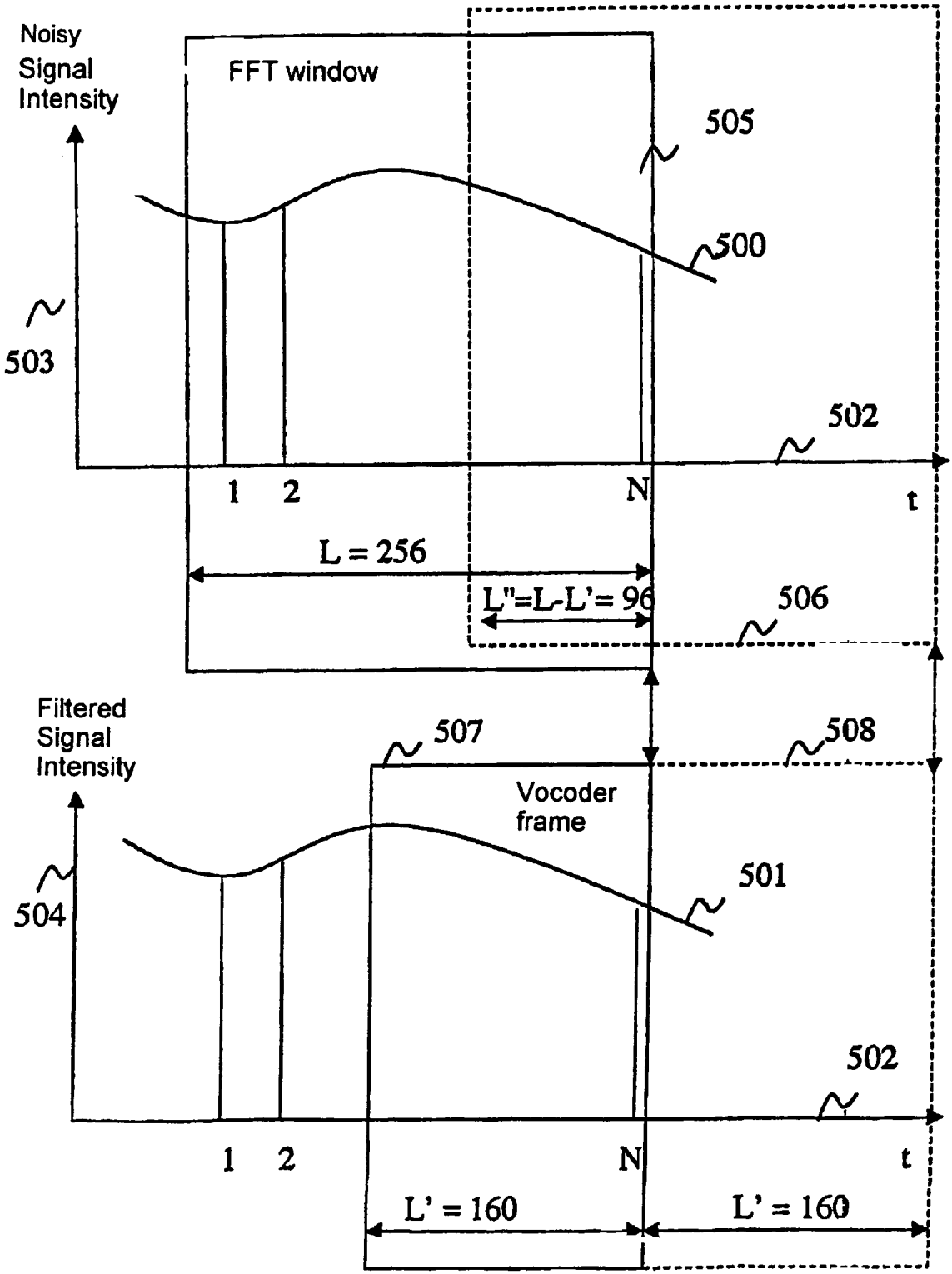
FIG. 5 describes a windowing of the flow of samples such as carried out by the processing in FIGS. 3 and 4.

FIG. 5 describes a windowing of sample sequences such as those carried out by the processing in FIGS. 3 and 4.

On a first graph, there is a representation of the curve 500 of the intensity 503 of the signal directly received from the converter 108 in accordance with the time t 502.

On a second graph, there is a representation of the curve 500 of the intensity 504 of the signal processed during the step 205 in accordance with the time t 502.

It is to be noted, on the first graph, that the time is cut into successive windows 505 and 506 of length L equal to 256, overlapping by a length L" equal to 96 and obtained during the step 302.

It is also to be noted, on the second graph, that the time is cut into successive frames 507 and 508 of length L' equal to 160, not overlapping and obtained during the transmission step 306.

The segmentation of the signal is such that, the windows 505 (respectively 506), and 507 (respectively 502) are perfectly synchronous.

Thus, according to the preferred embodiment, the windows 505 (respectively 506) and 507 (respectively 502) end up on the same sample before or after processing (according to steps 303, 304 and 305).

In this way, the overlapping is over a length equal to L'.

Figure 6:
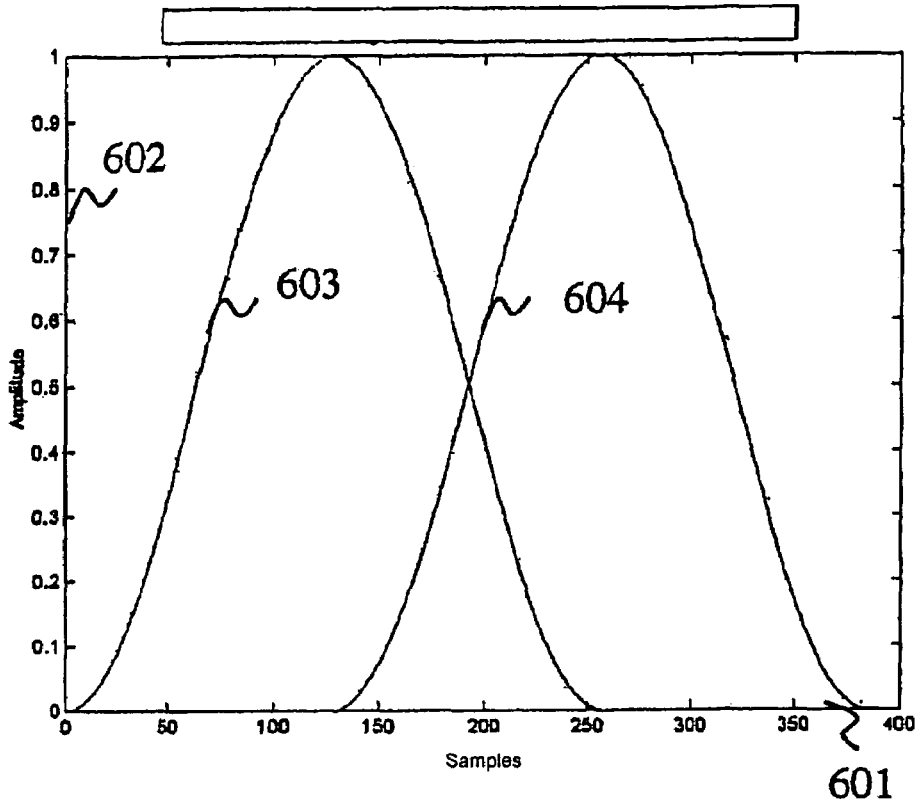
FIG. 6 illustrates a formatting window known per se.

FIG. 6 illustrates a formatting window known per se.

Represented on the graph giving the amplitude 602 is a window according to the order of a sample 601, the windows 603 and 604 of Hanning of length 256 with a covering of 128.

It is noted that according to this cutting known per se, the windowing cannot under any circumstances be synchronous with a segmentation in frames of 160 samples.

Figure 7:
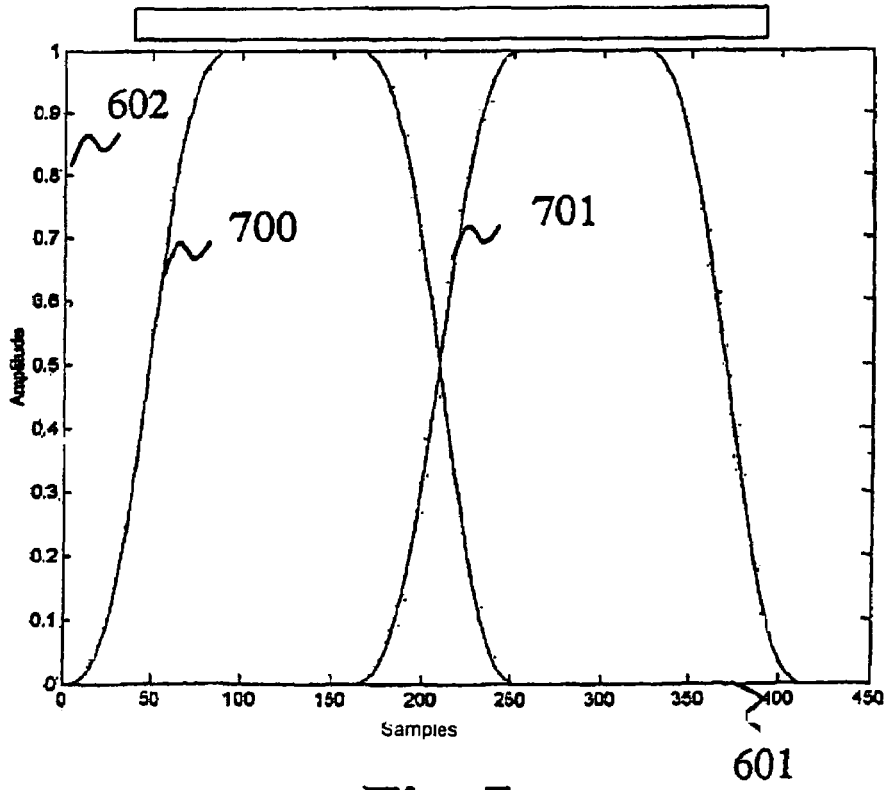
FIG. 7 illustrates an optimised formatting window used in the windowing operations in FIG. 3 according to a preferable embodiment of the invention.

FIG. 7 illustrates the formatting windows 700 and 701, optimised according to the invention (corresponding to the respective windows 505 and 506 in FIG. 5 but represented in greater detail).

As previously, the graph gives the amplitude 602 of a window according to the order of a sample 601.

It is noted that windows 700 and 701 are Hanning windows obtained via convolution of an intermediary Hanning window of length 97 with a rectangular window of length 160. Thus, with the successive offsetting of the windows, equal to 160 samples, perfectly reconstructed windows are obtained.

Figure 8:
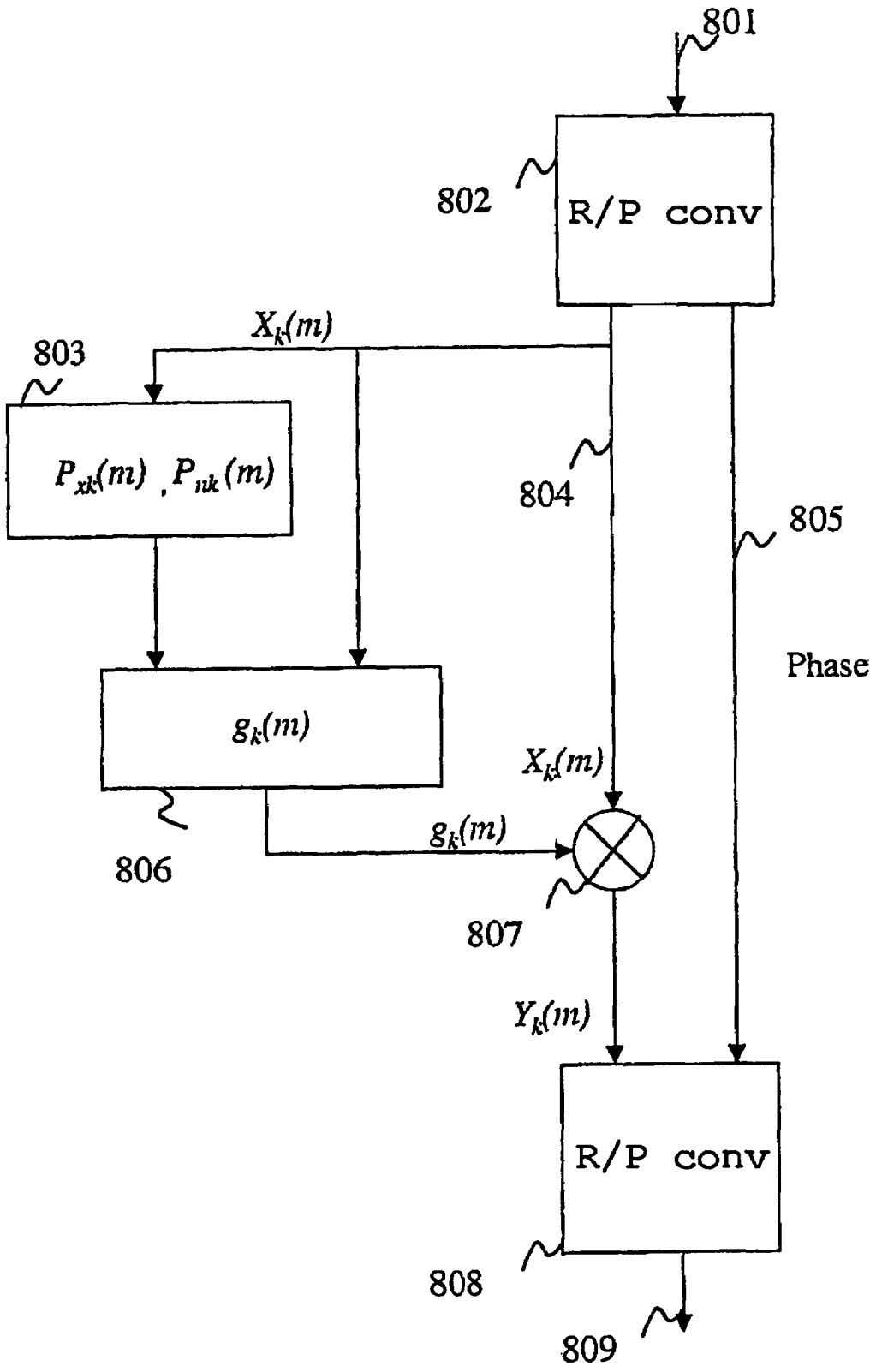
FIG. 8 describes more precisely a noise reduction processing of the type shown in FIG. 3.

FIG. 8 details the processing step 303 of noise reduction type such as is illustrated in FIG. 3.

This noise reduction processing is notably detailed in the following documents:

"Spectral substraction based on minimum statistics" written by R. Martin and published in the document "Signal Processing VII: Theories and Applications, 1994, EURASIP" on pages 1182 to 1185;

"Computationally efficient speech enhancement by spectral minima tracking in subbands", written by G. Doblinger and published in the report (pages 1513 to 1516) of the conference "ESCA. EUROPSPEECH'95, $4^{th}$ European Conference on Speech Communication and Technology"; and "A combination of noise reduction and improved echo cancellation" published in Germany by the collection "Fachgebiet Theorie der Signale" by the technology university of Darmstadt.

After having been processed according to step 302, a frame 801 comprising 256 spectral components corresponding to a sound effect speech signal is processed according to the process 303 detailed below.

The $k^{th}$ component of the $m^{th}$ sound effect speech signal frame is observed to be $X_k(m)$.

During an operation 802, the DSP 104 converts the components of the frame 801 of rectangular co-ordinates into polar co-ordinates so as to separate the spectral amplitude phase.

During the different processing, only the spectral amplitude will be modified, the phase remaining unchanged.

During a step 803, firstly the power $P_{xk}(m)$ of the signal is estimated on a short term according to the following relations:

$P_{xk}(1)=(1-\alpha|X_k(1)|^2$ (to which is possibly added a corrective value so as to improve the convergence speed of the estimation);

$P_{xk}(m)=\alpha P_{xk}(m-1)+(1-\alpha|X_k(m)|^2$ when $m>1$ with a value for the "forgotten" coefficient $\alpha$ comprised between 0.7 and 0.9 which allows sufficient research of the stationary speech spectre in the short term to be ensured.

These relations have two advantages in particular:

their ease of calculation; and the fact that no measuring delay is introduced.

According to a variation of the embodiment, a noise reduction improved algorithm is used. However, the introduction of an added delay in this algorithm would require an increased size of memory to store the spectral components with complicated values.

Then, the spectral power $P_{nk}(m)$ of the noise, according to the following non-linear estimator (which carries out, in a certain manner, a research of the temporal minima of $P_{xk}(m)$) is estimated:

$$P_{nk}(1)=P_{xk}(1);$$

and when m is strictly greater than 1 (m>1):

$$\text{if } P_{nk}(m-1) < P_{xk}(m)$$

$$\text{then } P_{nk}(m) = \gamma P_{nk}(m-1) + \frac{1-\gamma}{1-\beta}(P_{xk}(m) - \beta P_{xk}(m-1));$$

$$\text{otherwise } P_{nk}(m) = P_{xk}(m).$$

Then, during a step 806, the DSP 104 calculates a gain factor $g_k(m)$ in real values according to the following relations:

$$g_k(m) = 1 - \sqrt{\frac{\kappa P_{nk}(m)}{P_{xk}(m)}} \quad \text{if } g_k(m) > \beta_f$$

$$\text{and } g_k(m) = \beta_f \text{ otherwise.}$$

The coefficient $\kappa$ is a noise overestimation factor which is introduced to obtain better performances of the noise reduction algorithm.

$\beta_f$ corresponds to a minimum spectral value. $\beta_f$ limits the attenuation of the noise reduction filter to a positive value so as to let a minimal noise exist in the signal.

Then, during a step 807, the DSP 104 multiplies the amplitude $|X_k(m)|$ by the corresponding gain factor $g_k(m)$ so as to obtain the improved signal amplitude $|Y_k(m)|$ according to the following relation:

$|Y_k(m)|=g_k(m)\cdot|X_k(m)|$ for the values of $k$ comprised between 1 and 256.

Then, during a step 808 of conversion from polar to rectangular co-ordinates, the DSP 104 constructs the signal 809 with suppressed noise starting from the amplitude $|Y_k(m)|$ set during the step 807 and the extracted signal phase during the step 802.

The signal 809 is then processed according to the inverse Fourier transformation step 304.

Of course, the invention is not restricted to the aforementioned examples of implementation.

In particular, those skilled in the art could bring forth all types of variants in the application of the invention which is not restricted to mobile telephony (notably of GSM, UMTS, IS95, etc. type) but extends to every type of device comprising an audio coding before or after a mathematical transformation on an incoming audio signal.

Moreover, the invention applies not only to the processing of source speech signals but extends to every type of audio processing.

According to the invention, the applied mathematical transformation is notably of any type that applies to sample blocks of a specific length which is not equal to the size of the processed frames according to an audio processing or which is not a multiple or a divisor close to this frame size. Thus the invention extends to the case where the size of the audio frames is equal to 160 or more generally is not a power of 2 and where a mathematical transformation applies to block sizes of length 256, 128, 512 or more generally $2^n$ (where n represents a whole number) notably an FFT, a FHT or a DCT or the variants of these transformations (obtained, for example, via combining one or several of these transformations with one or several other transformations), etc.

Furthermore, the invention applies to any type of processing associated with mathematical transformation and carried out before or after a speech coding step, notably in the case of speech recognition or of echo cancellation and/or reduction.

It is noted that the invention is not restricted to the simple implantation of equipment but that it can also be implemented in the form of a sequence of instructions for a computer program or any form mixing a hardware part and a software part. In the case where the invention is partially or totally implanted in software form, the corresponding sequence of instructions can be stored in a removable storage means (such as, for example, a diskette, a CD-ROM or a DVD-ROM) or not, this means of storage being partially or totally readable by a computer or a microprocessor.

The invention claimed is:

1. Method for processing an audio signal comprising:

a first processing of a source audio signal, implementing a mathematical transformation applied to first sample sequences obtained via the application of first segmentation windows on the source audio signal;

a second audio processing, applied to second sample sequences obtained via the application of second segmentation windows on the signal delivered by the first processing, the second segmentation windows being distinct from the first segmentation windows;

wherein the two successive first windows and/or two successive second windows overlap, the overlapping being such that the segmentations are synchronous; and wherein the first segmentation windows comprises a window of perfect reconstruction obtained via convolution of:

a first intermediary window of perfect reconstruction and possessing spectral properties adapted to the mathematical transformation; and a second rectangular intermediary window.

2. Method according to claim 1 wherein the second segmentation windows comprise successive frames.

3. Method according to claim 2 wherein a last sample of a first sequence is also the last sample, after the first processing, of the corresponding second sequence.

4. Method according to claim 2 wherein the first processing applied to each first sequence comprises, in addition:

a pre-set processing sub-step applied to a first sequence;

an inverse mathematical transformation sub-step applied to the processed samples of the first sequence; and a process of adding speech samples issued from the inverse mathematical transformation sub-step applied to the first sequence and the corresponding speech samples issued from the inverse mathematical transformation sub-step applied to the preceding first sequence.

5. Method according to claim 4, wherein the pre-set processing sub-step comprises noise reduction or cancellation in the audio signal.

6. Method according to claim 4 wherein the pre-set processing sub-step comprises at least one processing belonging to the group comprising:

an echo reduction or cancellation in the audio signal; and a speech recognition in the audio signal.

7. Method according to claim 2 wherein the mathematical transformation belongs to the group comprising:

FFT and their variants; the Fast Hadamard Transformations (FHT) and their variants; and Direct Cosine Transformations (DCT) and their variants.

8. Method according to claim 2 wherein the source audio signal comprises a speech signal.

9. Method according to claim 1 wherein a last sample of a first sequence is also a last sample, after the first processing, of the corresponding second sequence.

10. Method according to claim 1 wherein the first processing applied to each first sequence comprises, in addition:

a pre-set processing sub-step applied to a first sequence;

an inverse mathematical transformation sub-step applied to the processed samples of the first sequence; and a process of adding speech samples issued from the inverse mathematical transformation sub-step applied to the first sequence and the of adding corresponding speech samples issued from the inverse mathematical transformation sub-step applied to the preceding first sequence.

11. Method according to claim 10, wherein the pre-set processing sub-step comprises noise reduction or cancellation in the audio signal.

12. Method according to claim 10 wherein the pre-set processing sub-step comprises at least one processing belonging to the group comprising:

an echo reduction or cancellation in the audio signal; and a speech recognition in the audio signal.

13. Method according to claim 1 wherein the mathematical transformation belong to the group comprising:

FFT and their variants;

Fast Hadamard Transformations (FHT) and their variants; and

Direct Cosine Transformations (DCT) and their variants.

14. Method according to claim 1 wherein the source audio signal comprises a speech signal.

15. A computer program product, wherein the program comprises sequences of instructions adapted to the implementation of a method of audio processing according to claim 1 when the program is run on a computer.

16. Device for processing an audio signal comprising:

a first processor configured to process a source audio signal, implementing at least one mathematical transformation applied to first sample sequences obtained via the application of first segmentation windows on the source audio signal;

a second processor configured to process audio applied to second sample sequences obtained via the application of second segmentation windows on the signal delivered by the first processor, the second segmentation windows being distinct from the first segmentation windows;

wherein two successive first windows and/or two successive second windows overlap, the overlapping being such that the segmentations are synchronous; and wherein the first segmentation windows comprise a window of perfect reconstruction obtained via convolution of:

a first intermediary window of perfect reconstruction and possessing spectral properties adapted to the mathematical transformation(s); and a second rectangular intermediary window.

17. A computer program product comprising program elements, registered on a readable support by at least one microprocessor, characterised in that the program elements control the microprocessor(s) so that they carry out:

a first processing of a source audio signal, implementing at least one mathematical transformation applied to first sample sequences obtained via the application of first segmentation windows on the source audio signal;

a second audio processing applied to second sample sequences obtained via the application of second segmentation windows on the signal delivered by the first processing, the second segmentation windows being distinct from the first segmentation windows;

two first successive windows and/or two second successive windows overlap, the overlapping being such that the segmentations are synchronous; and wherein the first segmentation windows comprise a window of perfect reconstruction obtained via convolution of:

a first intermediary window of perfect reconstruction and possessing spectral properties adapted to the mathematical transformation(s); and a second rectangular intermediary window.

18. Method for processing an audio signal comprising:

a first processing of a source audio signal, implementing a mathematical transformation applied to first sample sequences obtained via the application of first segmentation windows on the source audio signal;

a second audio processing, applied to second sample sequences obtained via the application of second segmentation windows on the signal delivered by the first processing, the second segmentation windows being distinct from the first segmentation windows;

wherein the two successive first windows and/or two successive second windows overlap, the overlapping being such that the segmentations are synchronous; and wherein the last sample of a first sequence is also the last sample, after the first processing, of the corresponding second sequence.

* * * * *